US007086184B2

(12) United States Patent
Archuleta, Jr. et al.

(10) Patent No.: US 7,086,184 B2
(45) Date of Patent: Aug. 8, 2006

(54) SUBSOILING GRAPPLE RAKE

(75) Inventors: James G. Archuleta, Jr., Roseburg, OR (US); Michael W. Karr, Idleyld Park, OR (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 0 days.

(21) Appl. No.: 10/781,612

(22) Filed: Feb. 18, 2004

(65) Prior Publication Data

US 2004/0187365 A1 Sep. 30, 2004

Related U.S. Application Data

(60) Provisional application No. 60/448,798, filed on Feb. 20, 2003.

(51) Int. Cl.
*E02F 3/96* (2006.01)

(52) U.S. Cl. ..... 37/406; 37/405; 37/404; 414/724

(58) Field of Classification Search ..... 37/405, 37/404, 403, 406, 468, 409, 410; 172/252, 172/445.1; 414/724
See application file for complete search history.

(56) References Cited

U.S. PATENT DOCUMENTS 3,496,844 A * 2/1970 Evans ..... 404/92
3,880,242 A * 4/1975 Rogers ..... 172/740
3,959,900 A * 6/1976 Luck ..... 37/404
4,041,624 A * 8/1977 Fryrear ..... 37/404
4,204,348 A * 5/1980 Lydie ..... 37/404
4,372,063 A * 2/1983 Work ..... 37/301
4,517,755 A * 5/1985 Nicholson ..... 37/404
4,519,739 A * 5/1985 Risch ..... 414/724
4,799,852 A * 1/1989 Ramun ..... 414/724
4,804,309 A * 2/1989 Risch ..... 414/704
4,845,867 A 7/1989 Albrecht
5,456,028 A 10/1995 Larson
5,515,625 A * 5/1996 Keigley ..... 37/405
6,067,736 A * 5/2000 Willis ..... 37/405
6,098,320 A * 8/2000 Wass ..... 37/406
6,311,417 B1 * 11/2001 Pratt ..... 37/404
6,408,551 B1 6/2002 Pettersson
6,490,815 B1 12/2002 Pratt
6,546,650 B1 * 4/2003 Meurer ..... 37/405
6,729,051 B1 * 5/2004 Hollen ..... 37/404
2003/0167661 A1 9/2003 Larson

* cited by examiner

*Primary Examiner*—Victor Batson
(74) *Attorney, Agent, or Firm*—John D. Fado; Curtis P. Ribando; Janet Stockhausen

(57) ABSTRACT

A grapple rake adapted for receiving subsoiler shanks is useful for multiple post-timber harvest management activities. A pair of downwardly-depending, forward-oriented subsoiling shanks is mounted on the underside of the rake, allowing the implement to accomplish the tasks of (1) grapple piling to deal with post-timber harvest fuels reduction and (2) subsoiling to improve soil productivity by reducing soil compaction. The implement is optionally equipped with a coulter blade. This invention will be useful for decommissioning forest roads, skid trails, landings, and harvest units with new and/or legacy compaction without the need for multiple pieces of heavy equipment or for multiple entries into the treatment area.

10 Claims, 6 Drawing Sheets

SUBSOILING GRAPPLE RAKE

CROSS-REFERENCE TO RELATED APPLICATION

This invention is related to provisional application 60/448,798, filed Feb. 20, 2003, and also to commonly-owned application assignable to the United States of America, as Represented by the Secretary of Agriculture, having the title "Subsoiling Excavator Bucket" and USDA Docket Number 0068.03, and naming James Geronimo Archuleta, Jr. and Michael William Karr as inventors, both herein incorporated by reference.

BACKGROUND OF THE INVENTION

1. Field of the Invention

This invention relates to a multi-purpose implement for conducting dissimilar forest and soil management activities, grapple piling (especially as related to Forest Fuel Management) and subsoiling (especially as related to soil productivity and restoration). The invention finds particular application in reforestation of newly created skid trails, landings and legacy compaction areas, as it applies to the growth and vigor of natural and planted stock trees and shrubs in reforestation projects. New impacts occur when equipment is brought into an area on a short-term basis, such as for fire-line construction, and the remedial treatment takes place shortly thereafter. The expression, "legacy compaction" as used herein refers to compaction from previous long-term activities, particularly those involving operating heavy equipment on the soil surface. Examples of situations that lead to legacy compaction include repeated travel on road fill, skid trails, dozer pile slash treatment and soil deposition from erosion that occurs over a work site at the toe of a hill. Whereas compaction from new impacts typically resides 4"–18" below the soil surface, legacy compaction may be deeper, and also may be accompanied by hardpan formation.

2. Description of the Prior Art

Following timber harvesting, reforestation activities sometimes include grapple rake/piling and subsoiling. The objectives of grapple piling are to deal with post-timber harvest fuels reduction. Grapple piling operations are almost exclusively associated with ground based timber harvest activities, which are credited with most of the detrimental compaction. Compaction has been associated with reduced mycorrhizal abundance and diversity in certain tree species, and also with ultimate growth rates and overall alteration of vegetation type. Soil compaction issues are typically not addressed immediately following harvest activities. Subsoiling has been proven to increase the survival and growth of seedlings in areas of previous compaction, but since there is a high cost associated with subsoiling, it is considered only after multiple planting failures and determination that a hardpan has indeed developed. Once a site has been replanted multiple times and has experienced surface losses of nutrient-laden soil, efforts to vegetate the area with desired stock may be greatly impaired regardless of renewed soil infiltration. Thus, after a ground-based harvest ends, skid trails and landings can be visible for years to decades.

In conventional practice, grapple piling and subsoiling (if performed at all) are conducted in separate operations. The grapple piling is done with log loaders or excavators using rakes, buckets and tongs. In a separate operation, subsoiling is conducted with a dozer pulling an agricultural subsoiling implement or dozer-mounted ripper system. Dozer subsoiling is used to treat compacted forest soils as a last resort and is carried out as quickly as the operator can maneuver through the harvest unit. Thick brush, stumps, boulders, and standing trees can inhibit the dozer from treating all compaction in the unit. This approach to subsoiling reduces compaction, but does not allow return of organic matter of varying size to the soil. Also, mats of organic matter tend to accumulate under the agricultural implement, resulting in a loss of organic matter from the soil surface. Carelessness during the subsoiler operation can also result in accumulation of rocks and boulders on the surface.

During grapple piling, some level of decompaction and return of organic matter to the surface can be achieved by forcing rakes, buckets or tongs into the compacted soil. However, the resultant soil profile becomes mixed rather than lifted, and the presence of unconsolidated rock or boulders can result in creation of a boulder field as in the case of inattentive dozer subsoiling operation dozer operation.

Grapple type implements are well-known. For example, various patented grapple designs are disclosed by Purser (U.S. Pat. No. 4,818,005), Murr (U.S. Pat. No. 5,890,754), Wolin et al. (U.S. Pat. No. 5,975,604) and Wheeler (U.S. Pat. No. 6,176,531). These devices are designed for single-function operation and can theoretically be used to decompact soil only by means of a churning motion. However, they are not designed for subsoiling; that is, for reducing compaction while retaining the characteristics of the soil profile.

Implements designed specifically for subsoiling are described by Williams et al. (U.S. Pat. No. 4,773,340), Gabriel (U.S. Pat. No. 5,121,800), and Grimm et al. (U.S. Pat. No. 5,605,196). Certain multi-functional implements, such as the spot-cultivation device of Willis (U.S. Pat. No. 6,067,736) are described in the literature. The implement of Willis is useful for both soil ripping and for raking.

Other types of multi-functional earth-moving equipment have been disclosed in the patent literature. For example, Larson (U.S. Pat. No. 5,456,028) shows a backhoe bucket having a single ripper attached to the same coupling element that secures the bucket to the end of a hydraulically powered boom. The result is concentration of the force provided by the boom to the ripper tip. Larson depicts various embodiments for coupling the ripper to the boom, but none are amenable to use with a "quick change" connector (tool coupler). Moreover, the pivotal mount of the ripper to the back of the bucket is susceptible to eventual stress failure. In Publication No. US 2003/0167661, Larson discloses an improvement in which the ripper is secured to a tool coupler to permit its use with a wide variety of interchangeable excavation tools.

Pratt (U.S. Pat. No. 6,490,815) shows an excavating bucket having a single ripping tooth or a pair of ripping teeth projecting rearwardly from the rear wall of the bucket. By virtue of this design the motion for functional operation of the ripper is opposite that of the bucket. In making a sweeping motion, the operator is able to alternatively break up hard material and scoop it up for removal.

SUMMARY OF THE INVENTION

We have now devised a combination grapple rake and subsoiler useful for multiple post-timber harvest management activities. In a preferred embodiment of the invention, a pair of downwardly-depending, forward-oriented subsoiling shanks is mounted on the underside of the rake. By virtue of this invention, a single implement can accomplish the tasks of (1) grapple piling to deal with post-timber harvest fuels reduction and (2) subsoiling to improve soil productivity by reducing soil compaction.

It is an object of this invention to provide a multi-purpose implement and method for grapple piling and subsoiling, and optionally for cutting through organic materials.

It is also an object of the invention to provide a multi-purpose implement and method that can simultaneously conduct the activities of grapple piling and subsoiling with little or no additional equipment and labor costs.

It is also an object of the invention to create a bridge in forest management practice that will reduce the chance of negative long-term influences of compaction in managed stands of timber by treating compaction directly after it is created and providing for necessary ground cover.

A further object of the invention is to provide an approach for decommissioning forest roads, skid trails and landings without the need for two different pieces of heavy equipment or for multiple entries with heavy equipment.

Other objects and advantages of this invention will become readily apparent from the ensuing description.

DETAILED DESCRIPTION

Figure 1:
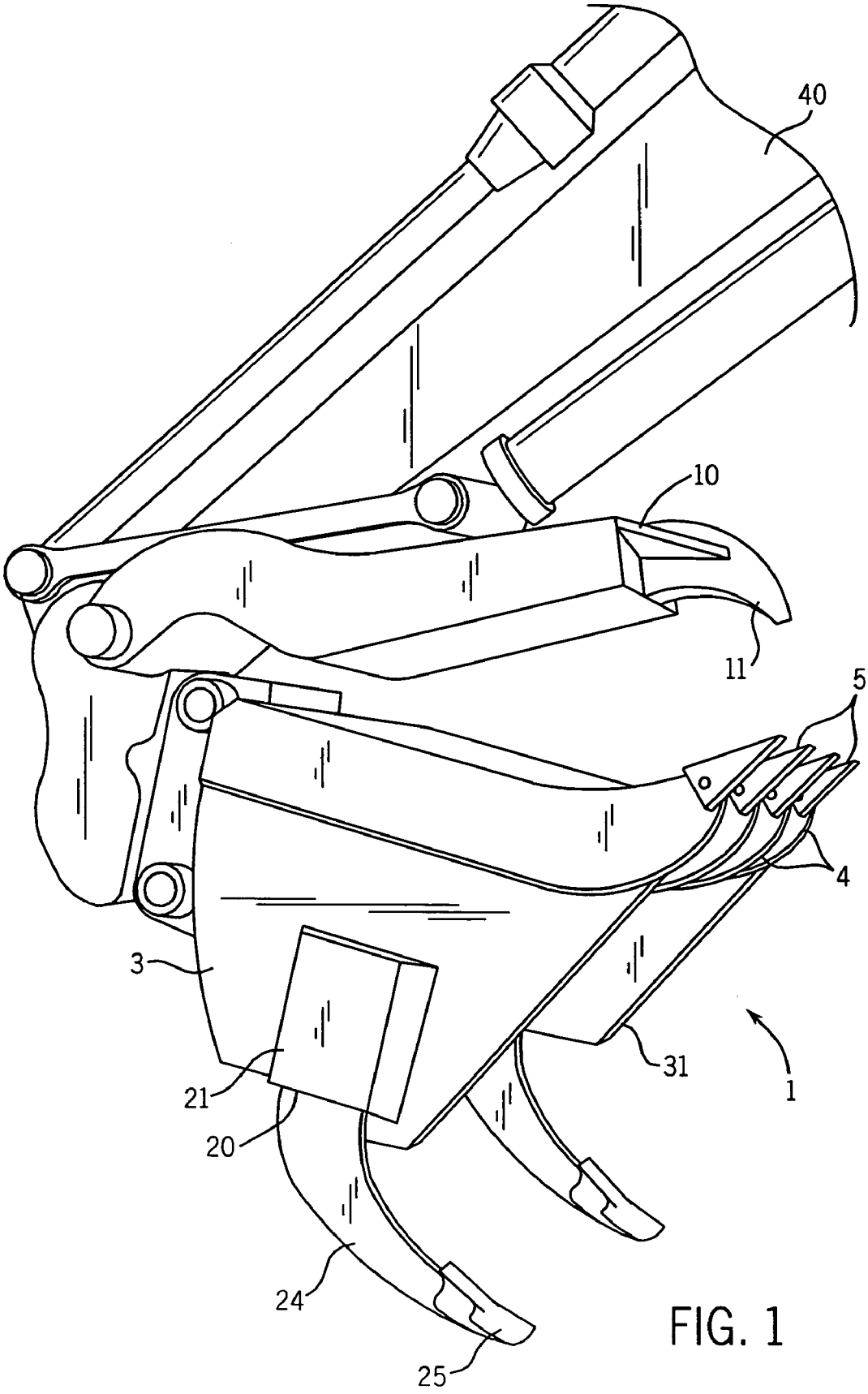
FIG. 1 is an oblique view of the multi-purpose grapple rake and subsoiler of the invention affixed to an excavator boom in combination with a thumb attachment.

It is understood that a grappling rake in operation can assume a large variety of positions relative to a given point of reference, such as the ground or the horizon. For purposes of the ensuing discussion, the toothed ends of the rake tines will be considered the front, and the opposite end of the rake the rear. As shown in FIG. 1, the rake attaches to the boom of the excavator implement at its top, so that the working end of the rake is free to pivot through a wide arc relative to the ground.

Figure 2:
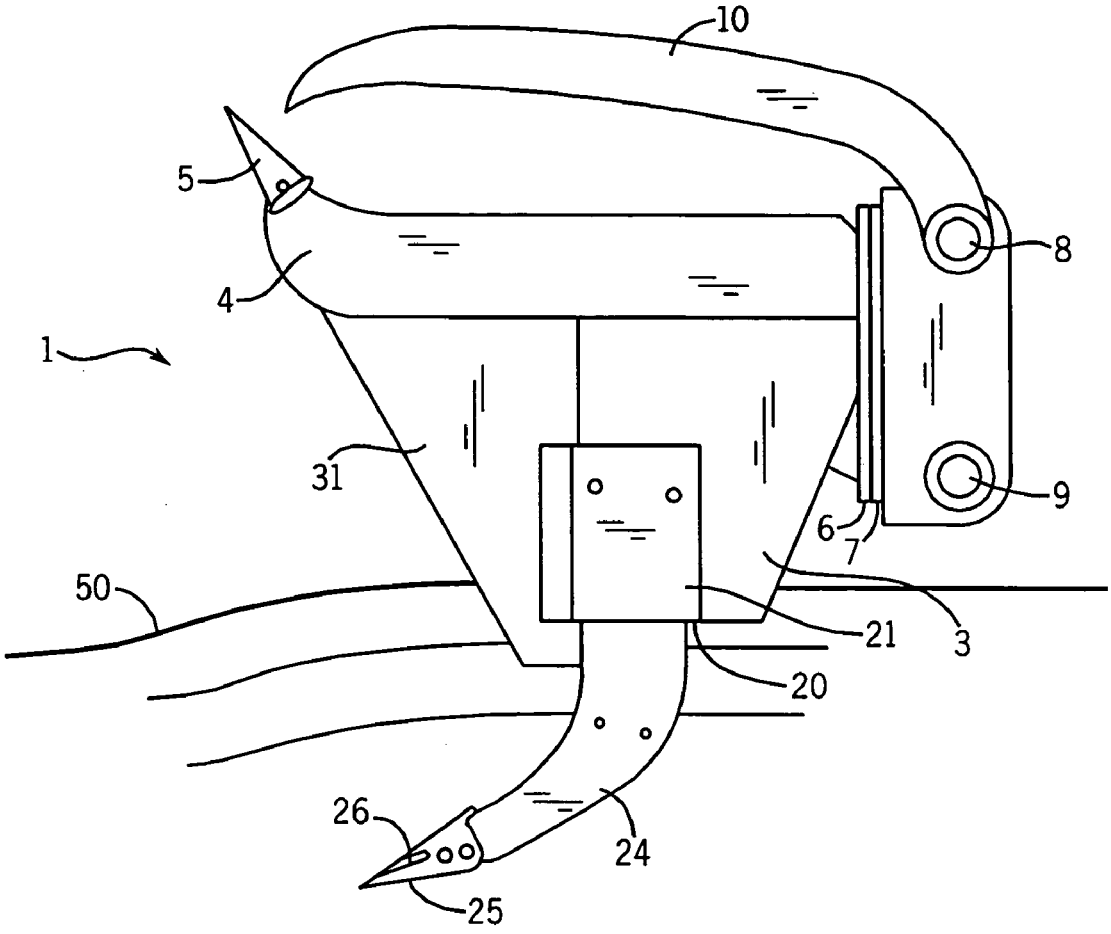
FIG. 2 is a side elevation view of the multi-purpose grapple rake and subsoiler of the invention in combination with a thumb attachment, with the subsoiling shanks in operational position below soil grade.
Figure 3:
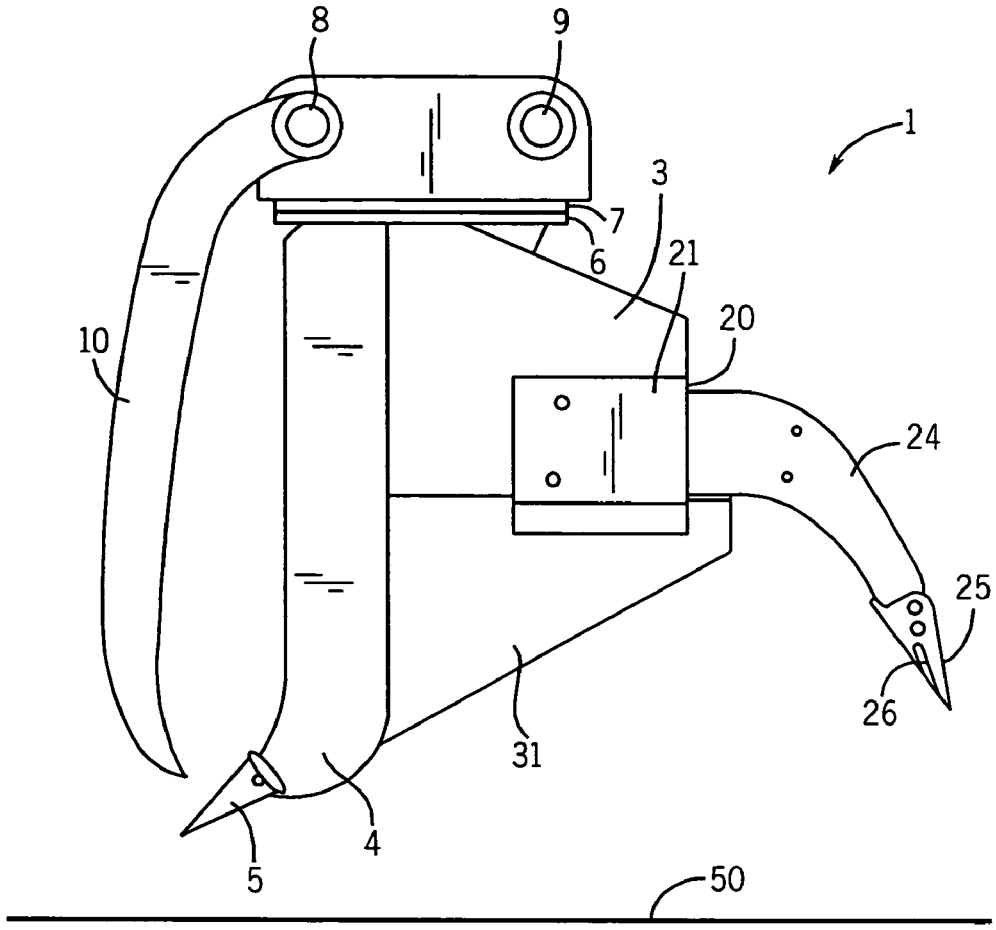
FIG. 3 is a side elevation view of the multi-purpose grapple rake and subsoiler of the invention in combination with a thumb attachment, with the grapple rake in operational position above soil grade.
Figure 4:
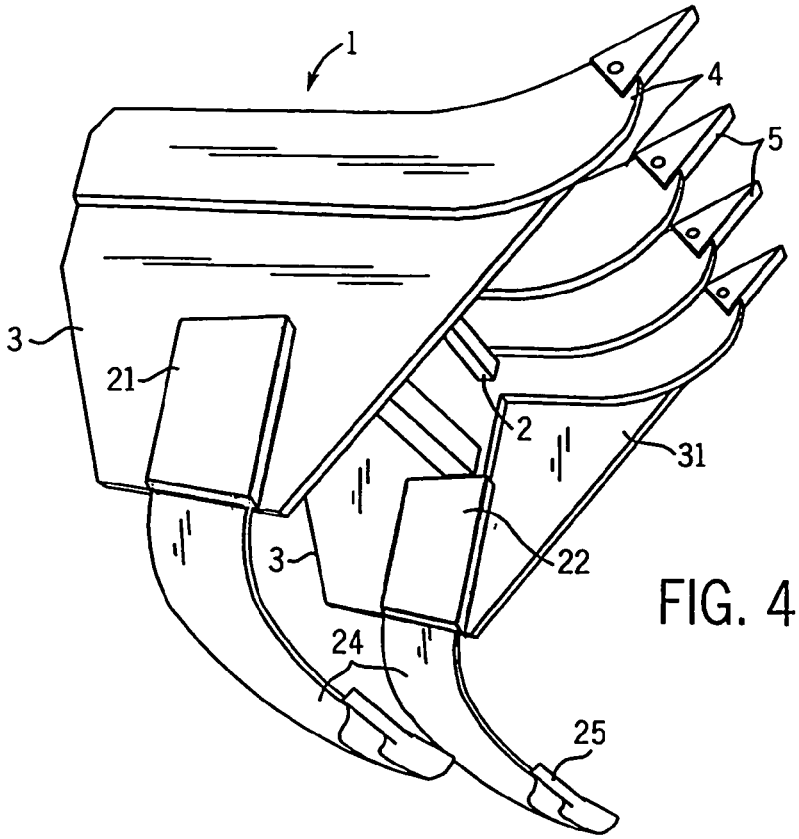
FIG. 4 is a perspective view of the multi-purpose grapple rake and subsoiler of the invention.
Figure 5:
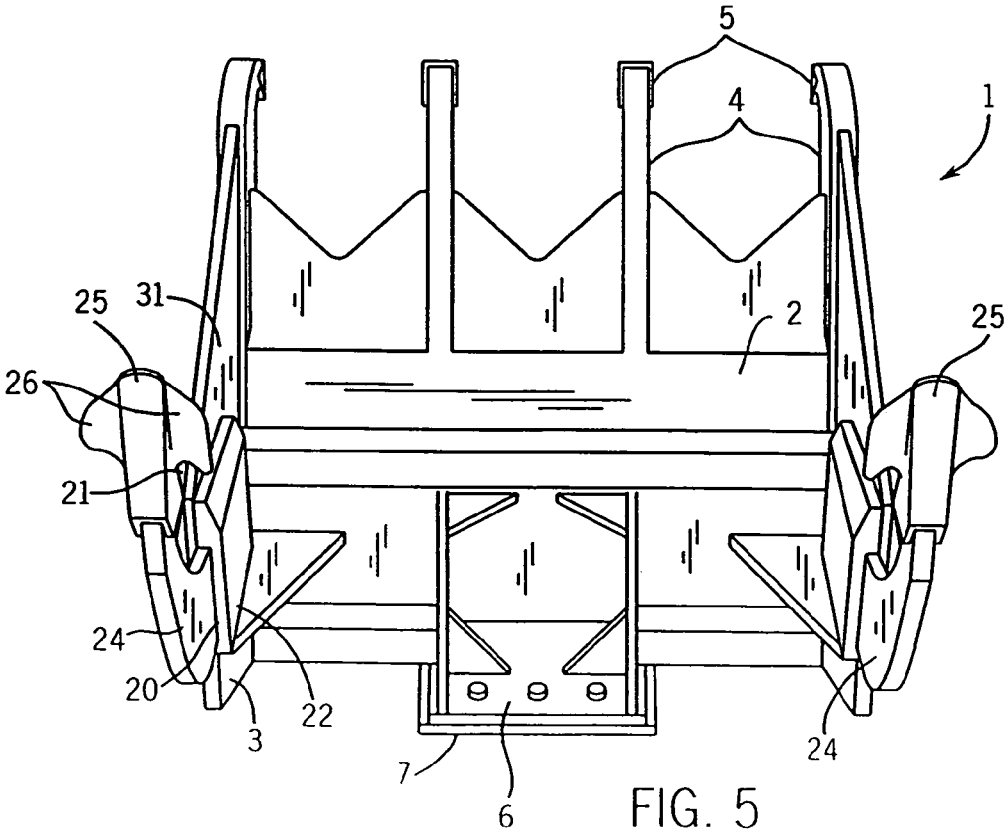
FIG. 5 is an elevation view of the underside of the multi-purpose grapple rake and subsoiler of the invention.

As best illustrated in FIG. 4, grapple rake 1 comprises a main frame structure 2 for supporting a plurality of tines 4. The leading edges of the tines 4 may also be fitted with teeth (chisels) 5. The frame structure also comprises a means, such as attachment plate 6 for securement to bearing plate 7 (FIGS. 2, 3 and 5). Bearing plate 7 comprises apertures or bearings 8 and 9 for mounting of the rake to the appropriate linkages of an articulated excavator boom 40 shown in FIG. 1.

As best shown in FIG. 5, side plates 3 affixed to main frame structure 2 each comprise a shank socket 20. The shank socket may be formed by an exterior plate 21 and an interior plate 22. Each socket 20 is adapted to receive and secure the proximal end of a subsoiling shank 24. The distal end of each shank is a substantially pointed earth-working tool, such as a hardened, abrasion-resistant ripper point 25 having one or more wing tips 26 lying in a plane substantially perpendicular to the plane of penetration of the subsoiling shank as depicted in FIG. 2. The shank is inserted into the open end of the socket and will typically be held in place in the socket by means of suitable fasteners that will permit easy removal and replacement. The curvilinear subsoiler shanks are oriented so that they are in an operating position when the rake is substantially parallel to the ground. Typically, the earth-working tool will be oriented so that the wing tips 26 are generally at a 90° (±15°) angle to the teeth 5 of the rake tines 4. In the preferred embodiment, the shank length is sufficient to subsoil at a depth of approximately 24"–30" below the soil grade 50 (see FIG. 2), and the shanks are positioned on the side walls of the rake so that the distal ends of the ripper points 25 are within 6" of a vertical plane passing through teeth 5 when the tines 4 are essentially horizontal (as during the subsoiling operation).

The shanks for subsoiling can be standard commercial parts (e.g. John Deere® part number A24206) or similar fabricated steel shanks, typically having a curvilinear profile. The shank length and degree of curvature will determine the maximum depth of subsoiling. With a given set of shanks, the equipment operator can control the actual depth of penetration into the soil, and thus the actual depth of decompaction. Depending on the depth of compaction and the subsurface strata (e.g. rock), the maximum operating depth can be controlled by means of both the shank length and operator control. It is also envisioned that the subsoiling depth can be varied by providing multiple mount positions within the socket. The use of ripper points on the subsoiling shanks can be standard commercial parts, such as John Deere® 5" or 7" sweeps. The size and angle/slope of wing tips can vary depending upon desired lateral fracture of compacted soil being treated.

The dual-shank embodiment described above is particularly appropriate for use in pumice soils. In alternate embodiments of the invention, the number of subsoiling shanks and/or shank spacing can be varied to accommodate other specific soil conditions. For example, in heavy (clayey) soils, it may be desirable to remove one of the subsoiling shanks or to reconfigure the rake so that there is a single subsoiling shank and shank socket. Of course, it would also be possible to increase the number of shanks and shank sockets for light soils.

In the preferred embodiment of the invention, the grapple rake/subsoiler of the invention is also equipped with a coulter blade 31 as illustrated in FIGS. 1–5. Coulter blade 31 may simply be an extension of side plates 3 and are firmly attached to the frame structure 2. The coulter blade leads the subsoiling shank through the soil, cutting grass mats and organic matter, surface or subsurface roots, etc. The position of the coulter blades between the underside of the rake tines and the subsoiling shanks serves to extend the maximum effective subsoiling depth. In one embodiment of the invention, the implement or implement coupling is equipped with a vertical orientation device (not shown) to provide feedback to the operator in regard to the attitude of the subsoiling shanks with respect to the soil surface. The orientation device may consist of a simple visual indicator, or may comprise an electrical and/or electronic device, such as a mercury switch and logic circuit with visual, auditory or other sensory signal as known in the art.

The articulated excavator boom 40 shown in FIG. 1 may also be equipped with a thumb 10 such as that described by Pisco, U.S. Pat. No. 5,813,822, herein incorporated by reference. The thumb 10 would typically comprise one or more fingers 11 which collectively serve to grasp objects or material such as brush, logs, rocks, and other logging debris that need to be placed into piles or moved from one location to another.

By pivoting the implement at the end of the excavator boom, the equipment operator can alternate from one mode to the other. Thus, while one mode of the implement is oriented in an operable position, the other mode is in an "idle" position. During subsoiling, the boom is extended away from the excavator, the tines of the rake are pivoted so that they are substantially parallel to the ground, thereby employing the distal ends of the subsoiling shanks into the proper position for movement through the soil: in a plane beneath, and generally parallel to, the soil surface (see FIG. 2). The implement is lowered toward the ground until the shanks penetrate the soil to the desired depth. As the boom draws the implement toward the excavator, the point-forward subsoiler shank curvature tends to draw the shanks down into the soil so that the proximal ends of the shanks are substantially perpendicular to the ground and distal ends are substantially parallel to the ground. As the shanks slice through the soil, the earth-working ends move through the soil along a path that is in a plane beneath, and generally parallel to, the soil surface. The desired effect of the subsoiling operation is obtained when the path of the earth-working ends is below the level of hardpan or other soil compaction. Thus, the depth of the plane should be sufficient to allow vegetation and tree roots adequate depth of soil decompaction to thrive. During movement of the subsoiler shanks through a zone of hardpan or soil compaction, the curvilinear shanks and wing tips impart an uplifting of the entire column of soil above and in front of the subsoiling shank and cause a fracturing of the hardpan and other soil strata. The lifting of the soil column takes advantage of the plate-like compacted soil structure to extend the lateral fracture to approximately 7–12 inches to either side (depending upon soil type and wing tip selection) from the centerline of the subsoiling shanks. The result is both a vertical and lateral decrease in the bulk density (or loosening) of the soil profile.

When a sizeable object such as a large root or tree branch is encountered during the subsoiling operation, the equipment operator obtains optimal functionality of the coulter blade by tilting the tine tips toward the ground, thereby pinning the object against the soil on the opposite side of the object from the coulter blade. This has the effect of imparting a guillotine action and enhancing the downward, shearing force on the object. The paired coulter blades and shanks cooperate with one another and serve to stabilize longer pieces of debris that exceed the breadth of the rake while being subjected to shearing forces. Shearing the debris prevents it from being pulled through the soil or across the soil surface by the subsoiling shanks, thereby helping to preserve the integrity of the topsoil or other soil stratum. Prior to lifting the subsoilers from the soil, it is desirable to retreat the boom a short distance along the previously subsoiled path so that the wing tips are raised through soil that is already fractured. This avoids catching the tips on rocks and other firmly entrenched objects that would tend to result in breakage of the tips and helps prevent soil displacement and mixing.

If it is desired to disperse organic matter over the subsoiled area, then the open end of the rake is pivoted into an operable position for grabbing debris, which is then lifted and dropped over the area. During employment of the grapple rake, the subsoiling shanks are oriented in idle position as shown in FIG. 3. Both the subsoiling and grapple raking can be conducted through the normal range of operation of the excavator boom. After treatment of an area within reach of the implement is complete, the piece of heavy equipment is retreated, that is, moved in a direction opposite from the area just treated.

The grapple rake/subsoiler of this invention may be used with any make of excavator, optimally one that is greater than 43,000 pounds and up to about 50,000 pounds gross vehicle weight rating (GVWR) to allow for adequate hydraulic power and excavator ability needed to obtain the full functional capacity.

The application of this implement can vary from basic grapple piling needs without subsoiling to full obliteration of a road on flat and rolling topography. Other potential uses are to rehabilitate forested environments, timber harvest brush disposal, skid trail and temporary logging road decommissioning, treatment of small and large scale acreage legacy compaction associated with prior timber harvest and land management activities, wildland fire dozer line rehabilitation, BAER (Burned Area Emergency Rehabilitation), and general subsoiling of compacted harvest units with no grapple piling. The same application could be applied to wetland restoration or creation done to mitigate wetland losses in areas under land development.

Figure 6B:
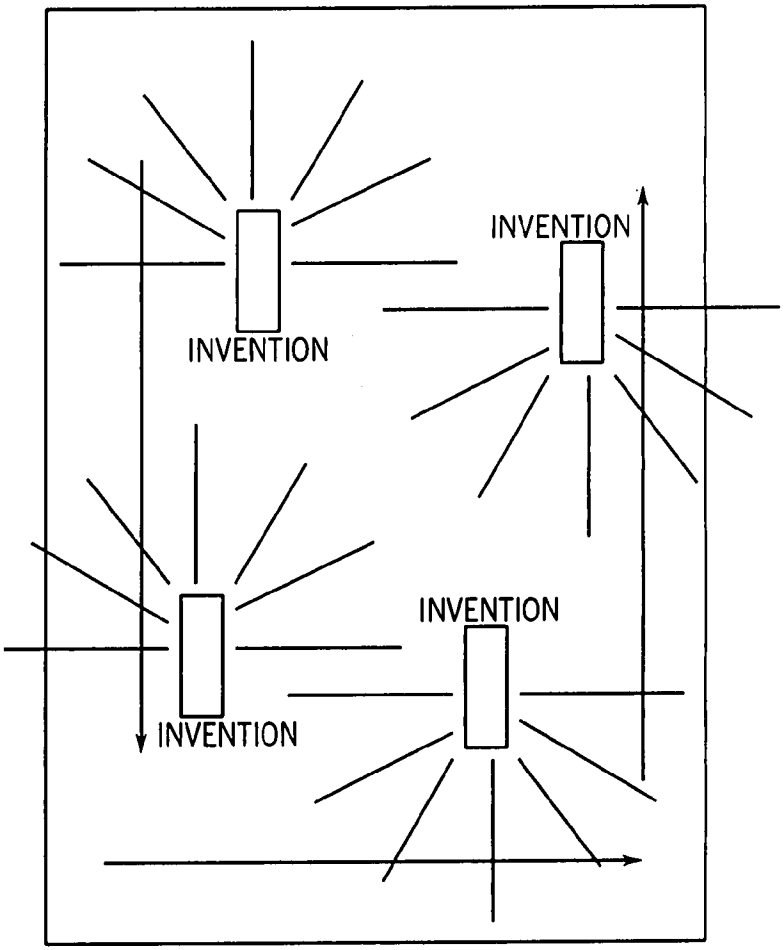
FIG. 6B is a schematic representation of the subsoiling pattern created by the combination grapple rake subsoiler of the invention.
Figure 6A:
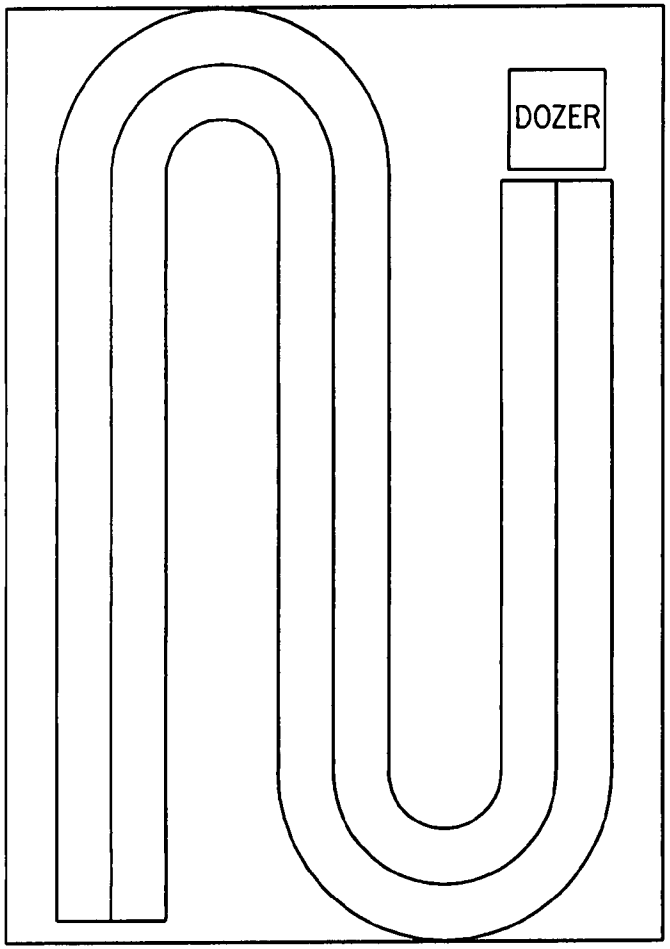
FIG. 6A is a schematic representation of the subsoiling pattern created by a subsoiling implement attached to a dozer.
Figure 6C:
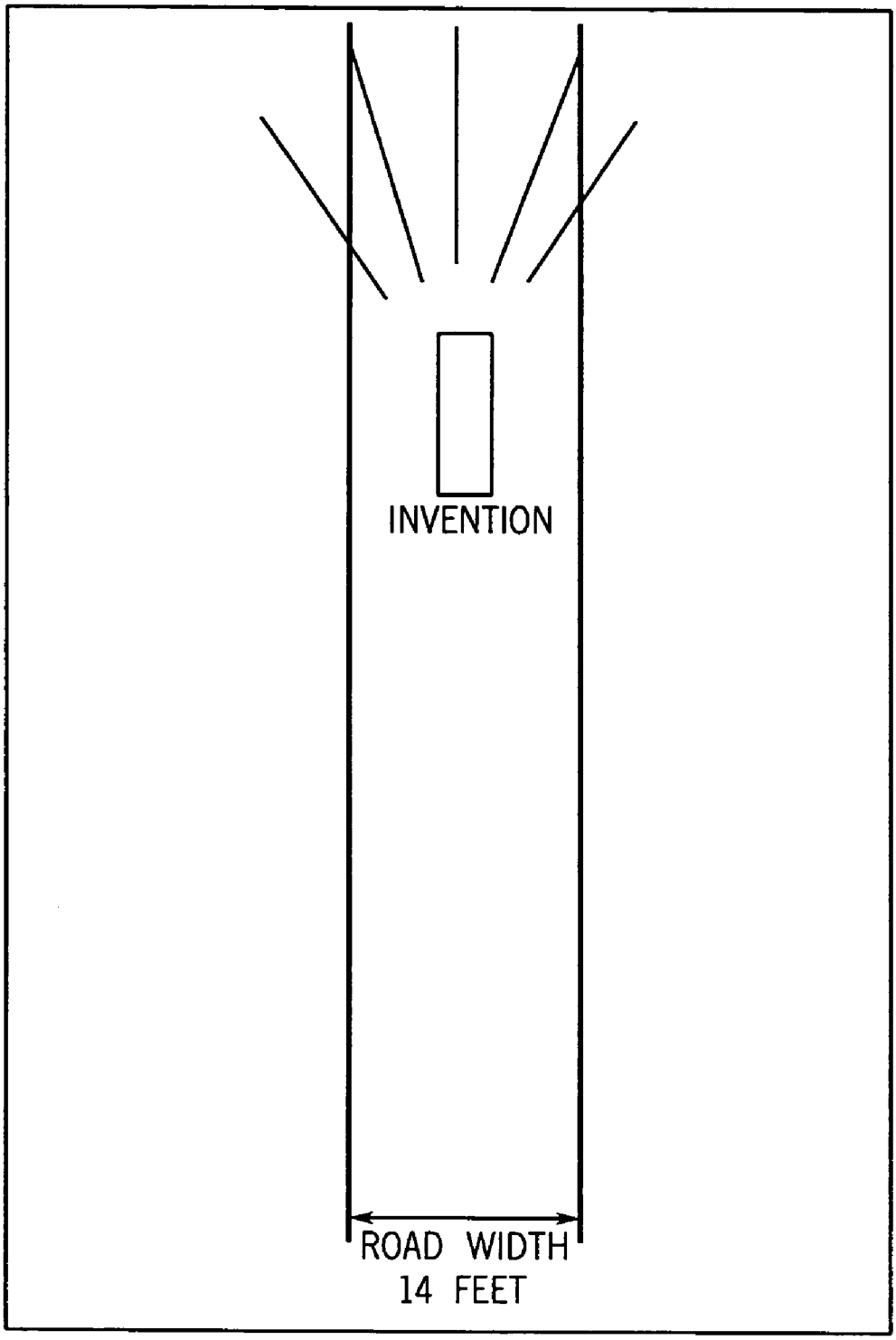
FIG. 6C is a schematic representation of the subsoiling pattern created by the combination grapple rake and subsoiler of the invention during road obliteration and decompaction.

FIG. 6B illustrates a desirable "broken" pattern of subsoiling achievable by the implement of the invention as it moves through a unit (as shown by arrows). The broken pattern is especially beneficial in the decommissioning of skid trails and other compaction on moderately steep slopes (e.g. 20–30%). This contrasts with the straight line "furrow" pattern imparted by a dozer-driven subsoiler as shown in FIG. 6A. The subsoiling pattern for a road being decommissioned by the invention is illustrated in FIG. 6C. By erasing the footprint of all previous and current equipment impacts, the inevitable lag time between management activity and restoration is shortened or eliminated. In a typical treatment, an area having soil compaction is first subsoiled, and then oversized organic material (logs, tree stumps, small trees, brush or boulders) is returned onto the restored landscape as groundcover. The implement is then repositioned for subsoiling in adjacent areas requiring treatment. Planting is usually scheduled for the following year to allow for subsidence of treated soil.

Field evaluations of the subject invention have demonstrated that 4–6 acres of ground could be treated for both slash and compaction per day. This parallels grapple piling alone, thus eliminating the cost of subsoiling in instances where these two prescriptions overlap. When compared to subsoiling using a grapple rake alone, the production of road decommissioning was 3.5 times higher with the subsoiler grapple rake of the invention. Thus, it is readily apparent that the invention will reduce reforestation costs incurred through replanting and inter-planting by eliminating legacy compaction.

All references disclosed herein or relied upon in whole or in part in the description of the invention are incorporated by reference.

We claim:

1. A combination grapple rake and subsoiling implement adapted for pivotal attachment to an excavating machine consisting essentially of:

(a) a frame;

(b) a plurality of discrete tines, wherein each of said tines has a proximal end securely attached to said frame and further wherein each of said tines has a distal end;

(c) a thumb pivotally attached to said frame by a proximal end in the vicinity of the proximal end of each of said tines;

(d) at least one shank socket affixed to said frame, said socket adapted to receive and secure a subsoiling shank having a substantially pointed earth-working end, and wherein said socket is further adapted to orient said shank in an operating position when said tines are substantially parallel to the ground; and (e) at least one coulter blade secure to one of said tines, said blade having a leading edge extending from the vicinity of the distal end of said one tine to the vicinity of said shank socket.

2. The grapple rake of claim 1, wherein said shank socket is adapted to receive at least one removable fastener for securing said subsoiling shank within said socket.

3. The grapple rake of claim 1 having two of said shank sockets.

4. The grapple rake of claim 1, and further comprising a subsoiling shank secured within said shank socket.

5. The grapple rake of claim 4, wherein said subsoiling shank lies substantially in a plane and comprises at least one wing perpendicular to said plane.

6. A combination grapple rake and subsoiling implement adapted for pivotal attachment to an excavating machine consisting essentially of:

(a) a frame;

(b) a plurality of discrete tines, wherein each of said tines has a proximal end securely attached to said frame and further wherein each of said tines has a distal end;

(c) a thumb pivotally attached to said frame by a proximal end in the vicinity of the proximal end of each of said tines;

(d) at least one shank socket affixed to said frame, said socket adapted to receive and secure a subsoiling shank having a substantially pointed earth-working end, and wherein said socket is further adapted to orient said shank in an operating position when said tines are substantially parallel to the ground; and (e) a curvilinear subsoiling shank secured within said shank socket;

(f) at least one coulter blade secured to one of said tines, said blade having a leading edge extending from the vicinity of the distal end of said one tine to the vicinity of said shank socket.

7. The grapple rake of claim 6, wherein the number of said shank sockets and the number of said shanks is one or two.

8. The grapple rake of claim 6, wherein said shank socket is adapted to receive at least one removable fastener for securing said subsoiling shank within said socket.

9. The grapple rake of claim 6 having two of said shank sockets.

10. The grapple rake of claim 6, wherein said subsoiling shank lies substantially in a plane and comprises at least one wing perpendicular to said plane.

* * * * *